United States Patent [19]

Rieck et al.

[11] Patent Number: 4,589,988

[45] Date of Patent: May 20, 1986

[54] SOFTENER-CONTAINING WASHING AGENT

[75] Inventors: Hans-Peter Rieck, Hofheim am Taunus; Hans-Jürgen Kalz, Liederbach; Adolf May, Hofheim am Taunus; Jochen M. Quack, Eppstein; Hans-Walter Bücking, Kelkheim, all of Fed. Rep. of Germany

[73] Assignee: Hoechst Aktiengesellschaft, Fed. Rep. of Germany

[21] Appl. No.: 729,650

[22] Filed: May 2, 1985

[30] Foreign Application Priority Data

May 4, 1984 [DE] Fed. Rep. of Germany ..... 3416472

[51] Int. Cl.[4] ..... D06M 1/02

[52] U.S. Cl. ..... 252/8.8; 252/8.6; 252/135; 423/332

[58] Field of Search ..... 252/8.6, 8.8, 135; 423/332, 333

[56] References Cited

U.S. PATENT DOCUMENTS

| | | | |
|---|---|---|---|
| 4,120,938 | 10/1978 | Haase et al. | 423/332 |
| 4,303,487 | 12/1981 | Carlin et al. | 423/332 |
| 4,368,127 | 1/1983 | Richmond | 252/8.8 |
| 4,384,130 | 5/1983 | Martin | 252/8.8 |
| 4,392,965 | 7/1983 | Woodward et al. | 252/8.8 |
| 4,399,043 | 8/1983 | Keil et al. | 252/8.8 |
| 4,399,044 | 8/1983 | Richmond | 252/8.8 |
| 4,439,335 | 3/1984 | Burns | 252/8.8 |
| 4,442,013 | 4/1984 | Fraikin et al. | 252/8.8 |
| 4,536,316 | 8/1985 | Ramachandran | 252/8.8 |

FOREIGN PATENT DOCUMENTS

| | | |
|---|---|---|
| 2742912 | 3/1979 | Fed. Rep. of Germany . |
| 3400132 | 7/1985 | Fed. Rep. of Germany . |

*Primary Examiner*—Paul Lieberman
*Assistant Examiner*—Willie J. Thompson
*Attorney, Agent, or Firm*—Connolly and Hutz

[57] ABSTRACT

Softener-containing washing agents which, in addition to the customary components of washing agents, contain 0 to 10% by weight of a quaternary ammonium compound and 1 to 30% by weight of a softener system which comprises 10 to 90% by weight of a tertiary amine and 90 to 10% by weight of a crystalline sheet-silicate of the formula $$Me_2Si_xO_{2x+1}\cdot yH_2O$$

in which Me denotes an alkali metal ion or a proton, x denotes a number greater than 7, in particular from 7.5 to 23, and y denotes a number smaller than 7 x, in particular smaller than x. In the softener system, the tertiary amine is in a state of adsorption on the alkali metal silicate. The ammonium compounds, which are adsorbed on said silicate, produce a softening effect in the washing agent but on the other hand are compatible with anionic surfactants in the washing agent. produce a softening effect in the washing agent but on the other hand are compatible with anionic surfactants in the washing agent.

7 Claims, No Drawings

SOFTENER-CONTAINING WASHING AGENT

It is known that washing, and subsequently drying, has the effect of producing an unpleasant harshening in the hand of textiles, in particular those which are made of cellulose fibers. This is true in particular of the wash in an automatic washing machine. It is also known that this undesirable harshening in hand can be eliminated by treating textiles which have been washed in a washing machine in the final rinse with quaternary ammonium compounds which contain at least two-long chain aliphatic radicals in the molecule. The compounds which have become established in practice for this purpose are in particular the water-suspendable dialkyldimethylammonium salts.

It is a disadvantage that these softening substances need to be applied separately from the main wash in the domestic washing machine, since the cationic compounds are not compatible with the anionic detergents in the washing agent. If these are used together, the cationic pro-ducts are removed from the washing system in the form of neutral salts and thus can no longer exhaust onto the fiber.

If use is made of washing agents which are based on nonionic detergents which are compatible with cationic softeners, the soil redeposits on the fiber, so that the washed articles admittedly have a pleasant soft hand, but the particles of soil are not detached by the wash. It has now been found that these abovementioned difficulties can be avoided and the harshening of washed laundry can be prevented, or fabric which has already been harshened by washing is given a soft hand again, if the washing agent used for the wash contains textile-softening systems which are based on certain crystalline alkali metal silicates.

The invention accordingly provides softener-containing washing agents which contain 0 to 10, preferably 1 to 5%, by weight of a compound of the formula

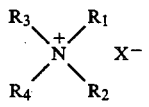

where $R_1$ and $R_2$ can be identical or different and denote hydrogen, $C_1$–$C_4$-alkyl, $C_2$–$C_3$-hydroxyalkyl or benzyl, $R_3$ denotes hydrogen, $C_1$–$C_{22}$-alkyl, preferably $C_{12}$–$C_{22}$-alkyl, $C_2$–$C_4$-hydroxyalkyl or benzyl, $R_4$ denotes $C_1$–$C_{22}$-alkyl, preferably $C_6$–$C_{22}$-alkyl, $C_4$–C2-2-alkoxyethyl or $C_4$–$C_{22}$-alkoxyethyl and X denotes an anion, and 1 to 30, preferably 10 to 15, % by weight of a softener system comprising (a) 10 to 90, preferably 30 to 70, % by weight of a compound of the formula

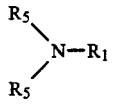

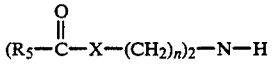

or

-continued

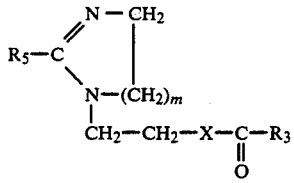

where $R_5$ denotes $C_6$–$C_{22}$-alkyl, $C_4$–$C_{22}$-alkoxyethyl or $C_4$–$C_{22}$-alkylphenoxyethyl, n denotes a number from 1 to 12, preferably from 1 to 3, m denotes 1 or 2, and X denotes NH or O and $R_1$ has the abovementioned meaning, and (b) 90 to 10, preferably 70 to 30, % by weight of a crystalline alkali metal silicate from the group of the phyllosilicates of the formula $$Me_2Si_xO_{2x+1}\cdot yH_2O$$

where Me denotes an alkali metal ion or a proton, x denotes a number greater than 7, in particular from 7.5 to 23, and y denotes a number smaller than 7 x, in particular smaller than x.

The abovementioned crystalline alkali metal silicates (sheet-silicates) have a fundamentally different molecular structure from the smectites which are mentioned in many patent specifications and which include montmorillonites and hectorites, since they contain no magnesium or aluminum, except in small amounts as possible impurities. Unlike the smectites, the total amount of MgO and $AL_2O_3$ in the silicate is always less than 15% by weight, but normally less than 5% and preferably less than 2%. The alkali metal silicates used in the present invention and the corresponding free silicic acids can be classed as phyllosilicates. Their water-free composition can be explained with the indicated formula. The alkali metal ions can be wholly or partly replaced by protons, so that Me in this case can stand for protons or different alkali metals. The term alkali metal silicates accordingly also encompasses in all cases the corresponding free silicic acids. It is preferable for Me to be sodium. The ion exchange capacity of the crystalline alkali metal silicates used in the invention is 130–400 mmol of $Me^+$/100 g of water-free silicate. The silicates have in the X-ray diffraction diagram one or more reflections within the range of d values from 3.0 to $4.0\times10^{-8}$ cm, which cannot be assigned to quartz, tridymite and cristobalite.

The crystalline alkali metal silicates used in the invention can be natural or synthetic, such as, for example, naturally occurring magadiite, $Na_2Si_{14}O_{29}\times11H_2$, and kenyaite, $Na_2Si_{22}O_{45}\times10H_2O$ (H. P. Eugster, Science, 157, 1177–1180 (1967)) and synthetic products having the composition $Na_2Si_8O_{17}$, $K_2Si_8O_{17}$ and $Na_2Si_{14}O_{29}$ (R. K. Iler, J. Colloid Sci., 29, 648–657 (1964); German Pat. No. 2,742,912; G. Lagaly, K. Beneke and A. Weiss, Am. Mineral., 60, 642–649 (1975)). The particle size of the silicates which are to be used according to the invention is preferably 0.1 to 50μ.

The synthesis of the sheet form alkali metal silicate, in particular of the sodium and potassium salts, is customarily effected under hydrothermal conditions from silica gel, silica sol or precipitated silicic acid in the presence of alkali metal hydroxide. Occasionally it is not an alkali metal hydroxide solution which is used but a corresponding carbonate solution. The amount of alkali in the synthesis depends on the desired product.

However, for the purposes of the present application particular preference is given to those crystalline alkali metal sheet-silicates whose preparation is described in German Patent Application No. P 34 00 132.8. In this process, an alkali metal silicate which is in solution in water or is amorphous and has a molar ratio of $M_2O/SiO_2$ of 0.24 to 2.0, where M stands for an alkali metal, has added to it sufficient of an acid compound to produce a molar ratio of $M_2O$ (non-neutralized)/$SiO_2$ of 0.05 to 0.239, if desired the mixture is diluted to set a molar ratio of $SiO_2/H_2O$ of 1:5 to 1:100, and the reaction mixture is held at a reaction temperature of 70° to 250° C. until the alkali metal sheet-silicate has crystallized out. M preferably stands for sodium or potassium.

A preferred, very reactive starting compound is sodium silicate having an $SiO_2$ content of about 22 to 37% and a $Na_2O$ content of 5 to 18% and an $AL_2O_3$ content of less than 0.5%. Particular preference is given to a sodium silicate containing 22–30% by weight of $SiO_2$ and 5–9% by weight of $Na_2O$. However, it is also possible to use amorphous alkali metal silicates, in particular solid sodium silicates and potassium silicates, which can also be anhydrous but which are soluble in water at least at the reaction temperature.

The added acid compound can be an acid anhydride or an acid salt such as sodium hydrogensulfate. However, preference is given to free organic or inorganic acids. Particular preference is given to inorganic acids, such as phosphoric acid or sulfuric acid.

The amount of acid compound to be added depends on the starting silicate and on the desired end product. The $M_2O/SiO_2$ ratio in the end product which is formed is virtually always lower than that of the reaction mixture from which the end product forms. In the end products the atomic ratio of alkali metal/silicon is between about 1:4 and 1:11. The pH of the product mixture after the acid compound has been added is generally above 9. It is preferable to set a pH between 10 and 12. The addition of the acid compound has the effect of buffering the reaction system.

This process can be used to obtain pure products or mixtures of crystalline alkali metal sheet-silicates. The alkali metal sheet-silicates obtained are capable of ion exchange. Their X-ray diffraction diagrams are similar to those of known alkali metal sheet-silicates.

The synthesis can be carried out not only in the presence of alkali metal ions but also in the additional presence of other metal ions, for example germanium, aluminum, indium, arsenic and antimony, and of the nonmetals boron and phosphorus. Provided the amount of these components is less than 10%, based on the alkali metal content, the effect on the synthesis is all but insignificant. To prepare a pure alkali metal sheet-silicate or the corresponding free acid it is advantageous to dispense with the presence of foreign metals during the synthesis. Pure sheet-silicates having a cation other than alkali can be readily obtained in a further step, namely ion exchange with the alkali metal salt or neutralization of the corresponding free acid. The process described can also be carried out in the presence of small amounts of organic compounds; however, it is preferable to work in the absence of any organic compound whatsoever.

In the process described, the molar ratio of $H_2O/SiO_2$ in the starting materials is preferably 8:1 to 40:1. To prepare low-alkali sheet-silicates (atomic ratio M/Si from 1:7 to 1:11) in this process it is frequently advantageous to use a higher dilution with water than for the preparation of higher-alkali sheet-silicates (atomic ratio M/Si from about 1:4 to 1:7). The reaction temperature is preferably 130°–230° C., in particular 160°–210°. Comparatively long reaction times, high reaction temperatures and low ratios of alkali (non-neutralized)-/$SiO_2$ favor the formation of low-alkali sheet-silicates, while short reaction times, low reaction temperatures and high alkali/Si ratios favor the formation of high-alkali sheet-silicates.

The reaction time depends to a large extent on the reaction temperature. The reaction can take anything from less than 1 hour to several months. The optimum reaction time can be determined for the chosen reaction temperature by taking samples for X-ray analysis at various times during the reaction.

The reaction is preferably carried out with thorough stirring in a pressure vessel. The addition of seed crystals is very advantageous, since this improves the purity of the product and shortens the reaction time. However, it is also possible to work without seed crystals. The presence of amorphous silicates, whether as admixtures or as byproducts of this type of preparation, is not troublesome, since they can act as builders in the washing agent. The phyllosilicates described can themselves likewise act as builders.

If the reaction is carried out as a discontinuous process, the amount of seed crystals can be up to 30% by weight, based on the $SiO_2$ content of the added alkali metal silicate, whether it is in solution in water or amorphous. Seed crystal levels below 0.01% by weight have no further noticeable effect. Instead of adding seed crystals, it can also be sufficient for small residues of an earlier batch to remain behind in the reaction vessel. In the case where the reaction is carried out as a continuous process, even significantly higher concentrations of crystal nuclei have been found to be advantageous under steady-state equilibrium conditions.

The process can be carried out discontinuously, semicontinuously or continuously, in apparatus having flow pipe, stirred vessel or cascade characteristics.

This process can be used to prepare various alkali metal sheet-silicates, including among others silicate Na-SKS-1, which is used in the Examples and which has an ion exchange capacity of about 140 to 157 mmol of $Na^+$/100 g of dry product (expressed relative to calcined product).

The use of the synthetic alkali metal sheet-silicates is particularly advantageous, since they normally contain no heavy metal ions which decompose the perborate.

The tertiary organic amines and quaternary ammonium compounds which are used in addition to the sheet-silicates are compounds which are known per se. The anion in the quaternary ammonium compounds is preferably a chloride, bromide, $CH_3SO_4^-$, iodide or $CH_3PO_4^-$ion or an acetate, propionate or lactate ion.

The softener system comprising crystalline alkali metal sheet-silicates and tertiary amines can be prepared by stirring these silicates for some time at about 20–65° C. in an aqueous or aqueous alcoholic solution of the cited tertiary amines. After about 0.5 to 1 hour of reaction time the suspension obtained is filtered and dried. Detailed descriptions of this reaction can be found in the literature (Lagaly et al., Organic complexes of synthetic magadiite; Proc. Int. Clay Conf., Madrid 1972, pages 663–673, Madrid 1973). The powders thus obtained are then admixed to the customary components of washing powder.

The quaternary ammonium compounds, which are usually commercially available in the form of aqueous solutions, are preferably likewise converted into a pulverulent derivative by treating the aqueous solutions of these products with silica powder. Silica powders for this purpose are commercially available as ®Sipernat 22 and ®Sipernat 50 (Degussa). The resulting pulverulent preparations of the quaternary ammonium compounds can likewise be admixed in a simple manner to the other components of the washing agent.

In addition to the quaternary ammonium compounds described above and the softener system, the washing agents also contain the customary components in the customary amounts, in particular anionic, zwitterionic and nonionic surfactants alone or mixed in an amount of in total 4 to 70, preferably 6 to 60, % by weight, in which the nonionic surfactants account for no more than 70% by weight, in particular no more than 10% by weight, of the total amount of surfactant.

The customary components of washing agents also include for example neutral to alkaline builders, complexing agents, bleaching components, perborate activators, foam stabilizers, foam inhibitors, anti-redeposition agents, enzymes and the like.

The compositions of washing agents according to the invention which are of particular practical interest are generally within the range of the following recipe:

About 6 to 60% by weight of a surfactant component which essentially comprises anionic surfactants of the sulfonate and/or sulfate type having preferably 8 to 18 carbon atoms in the hydrophobic radical, soaps and if desired nonionic surfactants which, if present, do not account for more than about 70% by weight and preferably for no more than 10% by weight of this surfactant component; 0.5–15% of the softener system described above; and 0–5% of the quaternary ammonium compound in powder form; and an amount which corresponds to the difference from 100% by weight of other washing agent components, in particular alkaline or neutral builders and other auxiliaries, such as, for example, bleaching agents, perborate activators, anti-redeposition agents, enzymes, brighteners, scents, color and water.

In the washing agents which contain soaps, the mixing ratio of the anionic surfactants of the sulfonate and/or sulfate type to soap is within the range from about 10:1 to 1:5, preferably 7:1 to 1:2. The washing agents can also contain a bleaching component which, in the above recipe, is regarded as part of the other washing agent components. If a bleaching component is present, it is preferably perborate, if desired combined with activators.

The washing agents according to the invention are suitable for washing cotton fabrics, delicate articles and easy care textiles, in particular those in cotton, polyester, acrylic and nylon, especially in the form of weaves and knits. The wash temperature is a temperature chosen within the range from 30° to 60° C. However, it is also possible to wash at temperatures at up to the boil.

The components of the light-duty, easy care and heavy-duty washing agents are previously disclosed components of the type already described extensively in the literature (cf. for example Schwartz, Perry, Berch, "Surface-active agents and detergents" Vol. 11 (1958), pages 25–93, 120–130 and 238–317); Lindner, "Tenside, Textilhilfsmittel, Waschrohstoffe" [Surfactants, Textile Auxiliaries, Detergent Bases]Vol. I (1964), pages 561–921 and 1035–1041; P. Bert, "Chemie und Technologie moderner Waschmittel" [Chemistry and Technology of Modern Washing Agents], Chemikerzeitung 94, 1970, No. 23/24, pages 974 et seq.

The anionic, zwitterionic and nonionic active detergents in the washing powders according to the invention can be in particular the following substances:

The anionic, zwitterionic or nonionic surfactants contain in the molecule at least one hydrophobic radical of usually 8 to 26, in particular 10 to 18, carbon atoms and at least one anionic, nonionic or zwitterionic water-solubilizing group. The preferably saturated hydrophobic radical is usually aliphatic, but can also be alicyclic; it can be bonded with the water-solubilizing groups either directly or via intermediate members. The intermediate members can be for example benzene rings or carboxylic acid ester or carboxamido groups. The anionic active detergent can also be soaps of natural or synthetic fatty acids or if desired of resin acids or naphthenic acids, in particular if these acids have iodine numbers of at most 30 and preferably of less than 10.

The synthetic anionic surfactants which are particularly important in practice are the sulfonates and sulfates. The sulfonates include for example the alkylarylsulfonates, in particular the alkylbenzenesulfonates, which are obtained, inter alia, from preferably straight-chain aliphatic hydrocarbons having 9 to 15, in particular 10 to 14, carbon atoms by chlorination and alkylation of benzene or from appropriate terminal or internal olefins by alkylation of benzene and sulfonation of the resulting alkylbenzenes. Also of interest are aliphatic sulfonates of the type which is accessible for example from preferably saturated hydrocarbons containing in the molecule about 8 to 18 and preferably 12 to 18 carbon atoms in a straight chain, by sulfochlorination with sulfur dioxide and chlorine or sulfoxidation with sulfur dioxide and oxygen and conversion of the resulting products into the sulfonates. The aliphatic sulfonates used can also be mixtures which contain alkenesulfonates, hydroxyalkanesulfonate and disulfonates and which are obtained, for example, from terminal or central olefins having about 8 to 18 carbon atoms by sulfonation with sulfur dioxide and acid or alkaline hydrolysis of the sulfonation products. In the aliphatic sulfonates thus prepared, the sulfonate group is frequently on a secondary carbon atom; however, it is also possible to use sulfonates having a terminal sulfonate group, which are obtained by reacting terminal olefins with bisulfite.

The sulfonates to be used according to the invention also include salts, preferably dialkali metal salts, of alpha-sulfofatty acids and salts of esters of these acids with monohydric or polyhydric alcohols containing 1 to 4 and preferably 1 or 2 carbon atoms. Further sulfonates which can be used are salts of fatty acid esters of hydroxyethanesulfonic acid or dihydroxypropanesulfonic acid, the salts of fatty alcohol esters of lower aliphatic or aromatic sulfomonocarboxylic or sulfodicarboxylic acids which contain 1 to 8 carbon atoms, the alkyl glyceryl ether sulfonates and the salts of the amidelike condensation products of fatty acids or sulfonic acids with aminoethanesulfonic acid.

Examples of surfactants of the sulfate type are fatty alcohol sulfates, in particular those from cocofat alcohols, tallowfat alcohols or oleyl alcohol. Terminal or internal olefins having about 8 to 16 carbon atoms likewise produce suitable sulfonation products of the sulfate type. This group of surfactants also includes sulfated fatty acid alkylolamides or fatty acid monoglycerides and sulfated alkoxylation products of alkylphenols ($C_{8-15}$-alkyl), fatty alcohols, fatty acid amides or fatty acid alkylolamides which can contain in the molecule about 1 to 20, in particular 2 to 4, ethylene and/or propylene glycol radicals.

Suitable anionic surfactants of the carboxylate type also include the fatty acid esters or fatty alcohol ethers of hydroxycarboxylic acids and the amidelike condensation products of fatty acids or sulfonic acids with aminocarboxylic acids, for example with glycocoll, sarcosine and the like.

The nonionic surfactants include products which owe their water-solubility to the presence of polyether chains, amine oxide, sulfoxide or phosphine oxide groups, alkylolamide groupings and, very generally, to an accumulation of hydroxyl groups. Of particular practical interest are the products which can be obtained by adding ethylene oxide and/or propylene glycol onto fatty alcohols, alkylphenols, fatty acids, fatty amines, fatty acid amides or sulfonamides and which can contain about 4 to 60, in particular 8 to 20, ether radicals, especially ethylene glycol ether radicals, per molecule.

The nonionic surfactants also include fatty acid or sulfonic acid alkylolamides which are derived for example from monoethanolamine, diethanolamine, dihydroxypropylamine or other polyhydroxyalkylamines, for example the glycamines. They can be replaced by amides of higher primary or secondary alkylamines and polyhydroxycarboxylic acids.

Suitable surfactants also include capillaryactive amine oxides; these include for example the products derived from higher tertiary amines having a hydrophobic alkyl radical and two shorter alkyl and/or alkylol radicals which each contain up to 4 carbon atoms.

Zwitterionic surfactants contain in the molecule both acid and basic hydrophilic groups. The acid groups include carboxyl, sulfo, sulfuric acid half-ester, phosphonic acid and phosphoric acid half-ester groups. Possible basic groups are primary, secondary and tertiary amine and quaternary ammonium groupings. Zwitterionic compounds having quaternary ammonium groups are classed as betaines.

The foaming power of the surfactants can be increased or reduced by combining suitable types of surfactant and by adding organic substances which are not surfactants. Suitable foam stabilizers, especially in the case of surfactants of the sulfonate or sulfate type, are capillary-active carboxybetaines or sulfobetaines and the abovementioned nonionics of the alkylolamide type; it has also been suggested that fatty alcohols or higher terminal diols be used for this purpose.

Products of reduced foaming power are chiefly intended for use in washing machines, where in some cases limited damping of foam is sufficient, while in other cases more marked damping of foam can be desirable. Special practical importance attaches to products which still produce foam within the middle temperature range of up to about 65° C., but on transition to higher temperatures of up to 100° C. produce increasingly less foam.

Reduced foaming power is fequently obtained by combining various types of surfactant, in particular by combining synthetic anionic surfactants, especially sulfates and/or sulfonates, or nonionic surfactants on the hand with soaps on the other.

But the foaming power of the surfactants can also be reduced by adding non-surfactant foam inhibitors known per se.

The builders in the washing agents according to the invention can be weakly acidic, neutral or alkaline inorganic or organic salts, in particular inorganic or organic complexing agents.

Examples of suitable, weakly acidic, neutral or alkaline salts are the bicarbonates, carbonates or silicates of alkali metals, and also monoalkali, dialkali or trialkali metal orthophosphates, dialkali or tetraalkali metal pyrophosphates, metaphosphates which are known for use as complexing agents, alkali metal sulfates and the alkali metal salts of organic non-capillary-active sulfonic, carboxylic and sulfocarboxylic acids containing 1 to 8 carbon atoms. These also include for example water-soluble salts of benzenesulfonic, toluenesulfonic or xylenesulfonic acid, water-soluble salts of sulfoacetic acid, sulfobenzoic acid or salts of sulfodicarboxylic acids and the salts of acetic acid, lactic acid, citric acid and tartaric acid.

Suitable complexing builders also include the weakly acidic metaphosphates and the alkaline polyphosphates, in particular tripolyphosphate. They can be wholly or partly replaced by organic complexing agents. Examples of organic complexing agents are nitrilotriacetic acid, ethylenediaminetetraacetic acid, N-hydroxyethylethylenediaminetriacetic acid, polyalkylene-polyamine-N-polycarboxylic acids and other known organic complexing agents; and it is also possible to use combinations of different complexing agents.

The perborate activators can be customary products of the group comprising N-acetyl and O-acetyl derivatives, such as, for example, tetracetylethylenediamine, tetraacetylglycoluryl or for example glucose pentaacetate.

EXAMPLES

The examples which follow feature three types of washing agent as representative of the large number of possible variations on washing agent formulations.

The compositions of the washing agents described in the examples can be seen in the tables below. The salt-like components contained in the washing agents—salt-like surfactants, other organic salts and inorganic salts—are in the form of the sodium salt, unless otherwise stated; the percentages are by weight, unless otherwise stated.

The following designations or abbreviations are used:

SAS stands for alkanesulfonate, a sulfonate obtained by sulfoxidation from paraffin having 13 to 18 carbon atoms.

ABS stands for alkylbenzenesulfonate, the salt of an alkylbenzenesulfonic acid which has 12 to 14 carbon atoms in the alkyl chain and is obtained by condensation of straight-chain olefins with benzene and sulfonation of the resulting alkylbenzene.

AOS stands for olefinsulfonate, a sulfonate which is obtained from olefin mixtures having 12 to 18 carbon atoms by sulfonation with $SO_3$ and hydrolysis of the sulfonation product with alkali metal hydroxide solution and which essentially comprises alkanesulfonate and hydroxyalkanesulfonate but also contains in addition small amounts of disulfonates.

FAAS stands for fatty alcohol ether sulfate, prepared by adding 3 mol of ethylene oxide onto 1 mol of a $C_{12}$ to $C_{14}$alcohol and subsequently sulfonating with $SO_3$ and neutralizing with NaOH.

N stands for nonionic surfactant, prepared from 1 mol of a fatty alcohol having a specifically indicated number of carbon atoms by reaction with specifically indicated moles of alkylene oxide (EO=ethylene oxide).

Soap of fatty acid mixture having 16 to 22 carbon atoms.

CMC stands for carboxymethylcellulose, sodium salt and NaTPP stands for sodium tripolyphosphate.

In the softener systems S 1 to S 3 used in the examples, the fabric softeners are tertiary amines as indicated, crystalline alkali metal silicate SKS-1 and , quaternary ammonium compounds as indicated.

The sodium silicate Na-SKS-1 was prepared as follows:

The first step was to prepare a reaction mixture of the molar composition $$0.303\ Na_2O{:}0.0052\ AL_2O_3{:}SiO_2{:}30H_2O$$

by adding 83.5 parts by weight of sodium silicate (27% of $SiO_2$,8.43% of $Na_2O$ and 0.24% of $AL_2O_3$) to 149 parts of water. One part of a filter-moist crystalline sodium silicate from an earlier experiment (71% weight loss on heating to 1200° C.; only the sodium silicate added in the first step to the water was taken into account in calculating the molar composition) was then added. 4.93 parts of 96% strength sulfuric acid were then slowly added with stirring. Thereafter the reaction mixture has the following molar composition:

$$0.174\ Na_2O{:}0.0052\ AL_2O_3{:}SiO_2{:}0.129\ Na_2SO_4{:}30\ H_2O$$

The reaction mixture is heated to 205° C. in a stainless steel autoclave in the course of 1.5 hours, is maintained at that temperature for 2.5 hours, and is then slowly cooled down. When cooled down, the reaction mixture is filtered, and the filter product is washed with water and is sucked off on a suction filter until dry. The filter-moist product has a calcination loss of 55%. The product, which has been briefly dried in air, is analyzed by thermogravimetry. The weight loss at a temperature of up to about 140° C. is 43%. There is no further significant weight loss until about 1000° C. The product, namely Na-SKS-1, which is dried at 120° C. to constant weight, has the following elemental composition: 3.8% of sodium, 0.24% of aluminum, 41.5% of silicon and 0.003% of iron. These figures can be used to work out that the molar $SiO_2/Na_2O$ ratio is 17.9. The X-ray diffraction diagram of the airdried sodium silicate (Na-SKS-1) is listed in the table below.

| d ($10^{-8}$ CM) | I/Io@ |
|---|---|
| 20.5 | 56 |
| 10.0 | 11 |
| 7.31 | 4 |

-continued

| d ($10^{-8}$ CM) | I/Io@ |
|---|---|
| 4.99 | 13 |
| 3.64 | 22 |
| 3.52 | 31 |
| 3.44 | 100 |
| 3.34 | 46 |
| 3.21 | 53 |
| 2.94 | 16 |

TABLE 1

Composition of softener systems S1 to S3

| Components | S1 % by weight | S2 % by weight | S3 % by weight |
|---|---|---|---|
| Alkali metal silicate SKS-1 | 60 | 60 | 60 |
| Compound of the formula $R_2N{-}CH_3$ | 40 | — | — |
| Compound of the formula $[R{-}CONH{-}(CH_2)_2]_z{-}NH$ | — | 40 | — |
| Compound of the formula 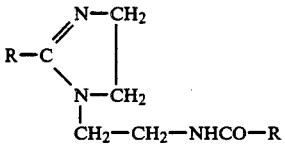 | — | — | 40 |

(R = hydrogenated tallow-fat alkyl)

These softener systems were incorporated in three different washing agent types, together with the quaternary ammonium compounds indicated below. The quaternary ammonium compounds were previously adsorbed onto finely divided silica (®Sipernat 50) and thus converted into powder form. The nature and amount of the quaternary ammonium compounds can be seen in Table 2 below. The adsorption onto the silica took place as described above by briefly heating a solution of the quaternary ammonium compound with the silica. These pulverulent preparations of the quaternary ammonium compounds will be referred to hereinafter as QAV.

TABLE 2

Composition of the quaternary ammonium compounds

| Components | QAV 1 % by weight | QAV 2 % by weight | QAV 3 % by weight |
|---|---|---|---|
| Dioctyldimethylammonium chloride | 70 | — | — |
| Trihydroxyethylmethylammonium ethosulfate | — | 70 | — |
| Benzyltrimethylammonium chloride | — | — | 70 |
| ® Sipernat 50 | 30 | 30 | 30 |

Composition of the washing agents (WAMI) = heavy-duty washing agents 60–95° C.

| Components | WAMI 1 S1/QAV 1 % by weight | 2 S2/QAV 2 % by weight | 2 S3/QAV 3 % by weight | Control % by weight |
|---|---|---|---|---|
| Softener system (S) | 15 | 15 | 15 | — |
| Quaternary ammonium compound (QAV) | 3 | 3 | 3 | — |
| SAS | 8 | — | 8 | — |
| ABS | — | 8 | — | 8 |
| N (tallow-fatty alcohol + 11 EO) | 2 | 2 | 2 | 2 |

-continued

| Composition of the washing agents (WAMI) = heavy-duty washing agents 60–95° C. | | | | |
|---|---|---|---|---|
| Components | WAMI 1 S1/QAV 1 % by weight | 2 S2/QAV 2 % by weight | 2 S3/QAV 3 % by weight | Control % by weight |
| Soap | 2 | 2 | 2 | 2 |
| NaTPP/Na Al silicate 1:1 | 38 | 38 | 38 | 38 |
| Na perborate | 10 | 10 | 10 | 10 |
| Na metasilicate | 5 | 5 | 5 | 5 |
| Perborate activator (TAED, TAGU, GPA) | 3 | 3 | 3 | 3 |
| Na magnesium silicate | 3 | 3 | 3 | 3 |
| CMC | 2 | 2 | 2 | 2 |
| Brightener | 0.3 | 0.3 | 0.3 | 0.3 |
| Remainder to 100% water, scent and other solids | | to 100% | | |

Control = commercially available washing agent without softening systems
TAED = tetraacetylethylenediamine@
TAGU = tetraacetylglycoluril
GPA = glucose pentaacetate
CMC = Carboxymethylcellulose

| Composition of the washing agents (washing agents for synthetics) 60° C. | | | | |
|---|---|---|---|---|
| Components | WAMI 4 S1/QAV 3 % by weight | 5 S2/QAV 2 % by weight | 6 S3/QAV 1 % by weight | Control |
| Softener system (S) | 12 | 12 | 12 | — |
| Quaternary ammonium compound (QAV) | 2 | 2 | 2 | — |
| SAS | 10 | — | 10 | — |
| ABS | — | 10 | — | 10 |
| N (tallow-fatty alcohol + 11 EO) | 2 | 2 | 2 | 2 |
| Soap | 2 | 2 | 2 | 2 |
| $Na_5P_3O_{10}$ Na Al silicate 1:1 | 32 | 32 | 32 | 32 |
| Na pyrophosphate | 14 | 14 | 14 | 14 |
| Na metasilicate + 4 $H_2O$ | 9 | 9 | 9 | 9 |
| CMC | 3 | 3 | 3 | 3 |
| Brightener | 0.3 | 0.3 | 0.3 | 0.3 |
| Remainder to 100% sodium sulfate, moisture, scent | | to 100% | | |

| Composition of the washing agents (light-duty washing agents) | | | | |
|---|---|---|---|---|
| Components | WAMI 7 S1/QAV 2 % by weight | 8 S2/QAV 1 % by weight | 9 S3/QAV 3 % by weight | Control % by weight |
| Softener system (S) | 20 | 22 | 18 | — |
| Quaternary ammonium compound | 4 | 5 | 3 | — |
| $Na_5P_3O_{10}$:Na Al silicate 1:1 | 12 | 12 | 12 | 12 |
| $Na_2OSiO_2$ | 4 | 4 | 4 | 4 |
| CMC | 3 | 3 | 3 | 3 |
| SAS | 15 | — | — | — |
| ABS | — | 15 | — | 15 |
| AOS | — | — | 15 | — |
| FAAS | 10 | 10 | 10 | 10 |
| N($C_9$–$C_{15}$—alcohol + 5 EO) | 5 | 5 | 5 | 5 |
| Remainder to 100% sodium sulfate, moisture, scent | | to 100% | | |

The brighteners used are, depending on the intended use of the washing agents, brighteners for cotton, brighteners for nylon, brighteners for polyester or combinations thereof.

The fabric-softening action of the washing agents WAMI 1–9 was demonstrated by comparison with the corresponding control washing agents which contained no softener systems, as follows:

Samples of new cotton terry fabric are washed three times at 60° C. together with makeweight fabric (liquor ratio 5:1 to 8:1) in a drum washing machine (AEG Lavamat Regina de Lux) containing a washing liquor which contains in each case, in a concentration of 7.5 g/l, the above-described washing agents which contain the fabric softener to be tested. As control, the above-described washing agents which are free of fabric softener are used in concentrations of 7.5 g/l, After each wash the fabric is rinsed, is hung up to dry, and is then left for 24 hours in a conditioning chamber at 20° C./60% relative humidity. The softening effect obtained in the washing trials is determined through independent assessment of the hand by 7 trained persons in each case.

The hand is assessed on a scale from 0 to 100 on which 100 denotes a full and very soft hand and 0 denotes a very harsh hand.

The limits of 0 and 100 are defined as follows:

Samples of new cotton terry fabric are treated 10 times under boil-wash conditions in water containing a commercially available heavy-duty washing agent in an automatic washing machine. When dried, the fabric prehardened in this way is assigned the hand assessment 0.

Samples of a new cotton terry fabric are stripped of stiffening finish and are treated with a solution of distearyldimethylammonium chloride (1.5 g of active substance softener per kg of fabric). The fabric softened in this way is given the hand assessment 100.

TABLE 3

| | Hand assessment | | |
|---|---|---|---|
| | Experiment 1 | Experiment 2 | Experiment 3 |
| WAMI 1 (S1/QAV 1) | 40 | 30 | 40 |
| WAMI 2 (S1/QAV 2) | 45 | 50 | 40 |
| WAMI 3 (S3/QAV 3) | 30 | 40 | 40 |
| Control (without softener systems) | 0 | 0 | 0 |

Result

Using washing agents according to the invention which contain softener systems (Examples WAMI 1–3) produces a hand improvement by 30–50% compared with washing powder of the same composition but without softener system.

We claim:

1. A softener-containing washing agent which contains 0 to 10% by weight of a quaternary ammonium compound of the formula

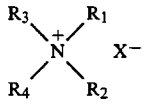

where $R_1$ and $R_2$ can be identical or different and denote hydrogen, $C_1$–$C_4$-alkyl, $C_2$–$C_3$-hydroxyalkyl or benzyl, $R_3$ denotes hydrogen, $C_1$–$C_{22}$-alkyl, $C_2$–$C_4$-hydroxyalkyl or benzyl, $R_4$ denotes $C_1$–$C_{22}$-alkyl, $C_4$–$C_{22}$-alkoxyethyl or $C_4$–$C_{22}$-alkylphen-oxyethyl, and X denotes an anion, and 1 to 30% by weight of a softener system comprising (a) 10 to 90% by weight of a compound of the formula

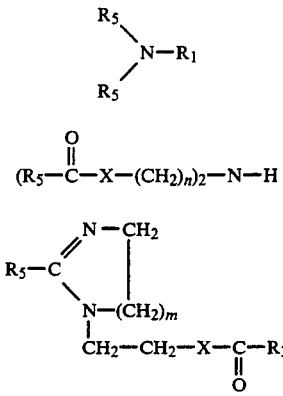

where $R_5$ denotes $C_6$–$C_{22}$-alkyl, $C_4$–$C_{22}$-alkoxyethyl or $C_4$–$C_{22}$-alkylphenoxyethyl, n denotes a number from 1 to 12, m denotes 1 or 2, and X denotes NH or O $R_1$ has the abovementioned meaning, and (b) 90 to 10% by weight of a crystalline alkali metal silicate from the group of the phyllosilicates of the formula $$Me_2Si_xO_{2x+1}\cdot yH_2O$$

where Me denotes an alkali metal ion or a proton, x denotes a number greater than 7, and y denotes a number smaller than 7 x.

2. The softener-containing washing agent as claimed in claim 1, which contains 1 to 5% by weight of the quaternary ammonium compounds and 10 to 15% by weight of the softener system which comprises 30 to 70% by weight of tertiary amine and 70 to 30% by weight of crystalline alkali metal silicate.

3. The softener-containing washing agent as claimed in claim 1, in which the softener system contains a crystalline alkali metal silicate of the indicated formula in which Me denotes sodium, X is a number from 7.5 to 23, and y is a number from 0 to 25.

4. The softener-containing washing agent as claimed in claim 1, which contains the quaternary ammonium compounds adsorbed onto finely divided silica.

5. The softener-containing washing agent as claimed in claim 1, wherein:

$R_3$ denotes $C_{12}$–$C_{22}$-alkyl;

$R_4$ denotes $C_6$–$C_{22}$-alkyl;

n denotes a number from 1 to 3;

x denotes a number from 7.5 to 23; and y denotes a number smaller than x.

6. The softener-containing washing agent as claimed in claim 2, wherein:

$R_3$ denotes $C_{12}$–$C_{22}$-alkyl;

$R_4$ denotes $C_6$–$C_{22}$-alkyl;

n denotes a number from 1 to 3;

x denotes a number 7.5 to 23; and y denotes a number smaller than x.

7. The softener-containing washing agent as claimed in claim 3, wherein $R_3$ denotes $C_{12}$–$C_{22}$-alkyl;

$R_4$ denotes $C_6$–$C_{22}$-alkyl;

n denotes a number from 1 to 3.

* * * * *